US012338602B2

(12) United States Patent
Kjaergaard et al.

(10) Patent No.: US 12,338,602 B2
(45) Date of Patent: Jun. 24, 2025

(54) SYSTEM FOR HANDLING THE SEAMLESS TRANSITION OF BREAKLINES DURING AN EXCAVATION TASK

(71) Applicant: LEICA GEOSYSTEMS TECHNOLOGY A/S, Odense SØ (DK)

(72) Inventors: Lars Kjaergaard, Odense SV (DK); Sean Costello, Altstätten (CH); Pierluigi Micarelli, St. Gallen (CH)

(73) Assignee: LEICA GEOSYSTEMS TECHNOLOGY A/S, Odense (DK)

( * ) Notice: Subject to any disclaimer, the term of this patent is extended or adjusted under 35 U.S.C. 154(b) by 189 days.

(21) Appl. No.: 18/223,474

(22) Filed: Jul. 18, 2023

(65) Prior Publication Data

US 2024/0018743 A1 Jan. 18, 2024

(30) Foreign Application Priority Data

Jul. 18, 2022 (EP) ..... 22185505

(51) Int. Cl.
*E02F 3/43* (2006.01)
*E02F 3/32* (2006.01)
(Continued)

(52) U.S. Cl.
CPC ..... *E02F 3/439* (2013.01); *E02F 3/32* (2013.01); *E02F 9/262* (2013.01); *E02F 9/265* (2013.01); *E02F 3/3681* (2013.01)

(58) Field of Classification Search
CPC . E02F 3/439; E02F 3/32; E02F 3/3681; E02F 3/437; E02F 9/262; E02F 9/265
(Continued)

(56) References Cited

U.S. PATENT DOCUMENTS 3,746,150 A * 7/1973 Briggs ..... E02F 9/02 198/304
6,456,287 B1 * 9/2002 Kamen ..... G06T 15/04 348/832
(Continued)

FOREIGN PATENT DOCUMENTS

DE 20 2011 003 220 U1 8/2011
EP 1 705 545 A1 9/2006
(Continued)

OTHER PUBLICATIONS

Extended European Search Report dated Jan. 13, 2023 as received in Application No. 22185505.9.

*Primary Examiner* — Krishnan Ramesh
(74) *Attorney, Agent, or Firm* — Maschoff Brennan

(57) ABSTRACT

A controller for an excavating machine, comprising a tool, an arm, a set of sensors and a chassis. The sensors being configured to provide data regarding a pose of the tool. The controller comprising an input interface and a computing unit. The input interface is configured to receive operator steering commands. The computing unit is configured to read a design model, comprising two interconnected polygons defining a breakline and to reference the pose of the tool to the design model. The controller is configured for performing a semi-automatic breakline-transition. The semi-automatic breakline-transition function including identifying a breakline-transition move based on the operator steering commands and the pose of the tool with respect to the breakline and generating operator steering command adjustment commands, based on the pose of the tool and the operator steering commands, in order to align the tool to the breakline.

17 Claims, 4 Drawing Sheets

(51) Int. Cl.
*E02F 3/36* (2006.01)
*E02F 9/26* (2006.01)

(58) Field of Classification Search
USPC ..... 701/50
See application file for complete search history.

(56) References Cited

U.S. PATENT DOCUMENTS

| | | | | |
|---|---|---|---|---|
| 9,976,285 | B2 * | 5/2018 | Padilla | E02F 3/435 |
| 11,373,370 | B1 * | 6/2022 | Breukelaar | G01C 7/02 |
| 2006/0061566 | A1 * | 3/2006 | Verma | G06T 17/20 345/582 |
| 2010/0101888 | A1 * | 4/2010 | Nakamura | B62D 12/00 180/442 |
| 2015/0347872 | A1 * | 12/2015 | Taylor | G06V 20/176 382/224 |
| 2016/0040399 | A1 * | 2/2016 | Congdon | E02F 3/8152 37/446 |
| 2020/0399862 | A1 * | 12/2020 | Okazaki | E02F 3/384 |
| 2023/0377268 | A1 * | 11/2023 | Hopkins | G06T 17/205 |

FOREIGN PATENT DOCUMENTS

| | | | |
|---|---|---|---|
| EP | 2 364 389 | B1 | 7/2017 |
| EP | 3 719 212 | B1 | 6/2021 |
| JP | 2010-071054 | A | 4/2010 |
| WO | 2014/209209 | A1 | 12/2014 |
| WO | 2020/050997 | A1 | 3/2020 |

* cited by examiner

SYSTEM FOR HANDLING THE SEAMLESS TRANSITION OF BREAKLINES DURING AN EXCAVATION TASK

FIELD OF THE DISCLOSURE

The present disclosure relates to an excavating machine equipped with a tool allowing up to six degree-of-freedom (DoF) in the position and orientation (pose) of the tool in the real space and a method for controlling the heading and the direction of motion of the tool in an excavation task during the transition from one polygon in the reference surface, to another polygon in the reference surface.

BACKGROUND

Excavators are construction machinery comprising a tool, in particular a bucket, an excavator arm for moving the tool, the excavator arm typically comprising multiple joints, e.g. a boom, a stick, a chassis, typically a chassis rotatable about 360°, on a movable undercarriage having tracks or wheels. These machines are used in many ways, e.g. for digging, landscaping, material handling. Generic excavators are typically equipped with an adapter allowing a rapid exchange of the tools configured for specific tasks. Due to that feature contemporary excavators may also be equipped e.g. with a hydraulic saw and mover for brush cutting or forestry task, with hydraulic claws, cutters and breakers for demolition work, with driving piles or hydraulic drills for mining task or with snowplows and snow bowlers for snow removing tasks.

Another typical embodiment of an excavating machine is a so-called backhoe excavator or backhoe. The chassis of an excavator is another type of work machine, e.g. a tractor and the excavator arm is attached in a permanent or temporary fashion to the backside of the work machine. E.g. JP 2010-71054A discloses such a work machine.

By the way of the example, unless otherwise specified, excavators representing from here on a more general class of excavating machines, the specific features of other types of excavating machines, in particular backhoes, might be applied accordingly.

By the way of example buckets are presented from here on as a representative of a generic tool of the excavator. The specific features of other types of excavator tools, e.g. rakes, might be applied accordingly. Furthermore, since generic excavators are typically configured to exchange the tools rapidly, without special preparatory steps, and under field conditions using the bucket as representative of a generic tool of the excavator, does not mean that an excavator has to be equipped with a bucket or any other tool in a permanent fashion.

Buckets comprise a bucket edge, the edge is dedicated for contacting a surface. Buckets themselves are also used in various shapes and size. For example, a wide, large capacity (mud) bucket with a straight cutting edge is used for cleanup and levelling. In particular, a straight cutting edge is typically used for soft material to be dug, wherein for harder material the cutting edge is formed by a row of teeth. By way of another example, a general purpose bucket is generally smaller, stronger, and has hardened side cutters and teeth used to break through hard ground and rocks.

Generic excavators have a house or cab for the excavator operator in the excavator chassis. The chassis is typically rotatable. Typical excavators share a basic setup, wherein the section of the excavator arm closest to the cab is referred to as the (main) boom, while the section which carries the tool is referred to as the stick (also referred to as the dipper or the dipper-stick). By the way of example unless otherwise specified a "conventional" excavator setup wherein the chassis is rotatable and the arm comprises the boom and the stick representing from here on a more general setup. The specific features of other types of setup, in particular swing boom excavators, might be applied accordingly.

A typical modern excavator utilizes hydraulic cylinders and motors to accomplish the movement of the arm. Other analogous methods, e.g. wincher and steel ropes are also possible. By the way of example hydraulic cylinders and motors are presented from here on as a representative of a generic mean of driving the excavator arm. The specific features of other means of driving the excavator arm, e.g. steel ropes, electric motors, etc. might be applied accordingly.

The (main) boom attaches to the cab, and can be one of several different configurations, e.g. a mono boom allowing no movement apart from straight up and down, or a knuckle boom articulating at the so-called "knuckle" near the middle, letting it fold back like a finger. Another option is a hinge at the base of the boom allowing it to pivot independent to the house, e.g. up to 180 degrees. However, the latter is generally available only to compact excavators. Further, somewhat specialized configurations are known, e.g. triple-articulated booms.

Attached to the end of the boom is the stick, wherein the stick length varies, e.g. depending whether reach (longer stick) or break-out power (shorter stick) is required. The stick length may also be hydraulically adjustable.

Typically, the tool is attached to the stick via a tool joint allowing at least a swiveling of the tool with respect to the stick in a pitch direction, typically up and down. Often also a swiveling in a tilt direction is possible, e.g. left and right.

A special excavator type further features a so-called tilt-rotator arrangement between the end of the stick and the tool in order to increase the flexibility and precision of the excavator. For example, such tilt-rotator excavators are often used in the countries of Scandinavia. A tilt-rotator can best be described as a wrist between the stick and the tool, allowing the tool to rotate—typically by 360 degrees—about a rotor axis, wherein the tool can further be swiveled, e.g. in each case up to ±45 degrees, about a pitch axis perpendicular to the rotor axis, and a tilt axis perpendicular to the rotor axis and the pitch axis. An excavator system and controls for a tilt-rotator is described e.g. in EP 2 364 389 B1.

A tilt-rotator allows the precise adjustment of the pose of the tool, in particular the tool edge, with 6 DoF and to define a direction of motion of the tool with a further independent 3 DoF in an external reference system. By the way of example tilt-rotators are presented from here on as a representative of a generic setup allowing the 6 DoF pose, in particular the heading, and 3 DoF direction of motion control of the tool in an external reference system. The specific features of other excavator arms with similar capabilities might be applied accordingly.

One widespread way of positioning the bucket or defining a direction for the bucket is that the operator defines the position of the hydraulic cylinders directly e.g. with a joystick, such control means are disclosed e.g. in EP 1 705 545 A1. However, even simple movements, like bringing the bucket straight forward in a horizontal movement at the same time as the bucket is opened, multiple coordinated movements on the joystick are needed. Since the orientation of the hydraulic cylinders changes constantly during the movement of the tool, these movements are not intuitive and error-prone. Consequently the execution is often unproductive even for the trained and experienced operator.

Systems which aid the driver to set a given real space position of the bucket are known in the prior art, e.g. WO 2014/209209 A1 discloses a system wherein the joints of the excavator arm are adjusted automatically to provide a real space movement designated by the operator.

A typical excavator has more DoF than are strictly necessary for the task of grading a planar surface. This means that the bucket edge can be aligned with the surface using multiple combinations of joint angles. There may also be multiple options for a repositioning path, and an optimal path with respect to certain criteria may be computed.

Semi-automatic remapping systems, in particular semi-automatic remapping systems based on inverse kinematics, wherein the operator only has to select a new target pose and the repositioning path is generated and controlled by a computing unit of the excavator, are known in the prior art, e.g. U.S. Pat. No. 9,976,285 B2 or EP 3 719 212 B1 discloses such a system.

A system wherein the position of the excavator and at least its bucket in an external coordinate system and in respect to a design data representing the construction task is also known in the prior art. E.g. EP 3 719 212 B1 discloses a system, wherein the absolute or relative position of the excavator is determined utilizing a sensor arrangement and the bucket is moved upon an operator command to a desired pose with respect to the design data.

The design data typically comprises a reference surface. For a typical excavating task the reference surface, e.g. a ditch or a railway embankment, consists of polygons. The joining of the polygons are known as breaklines. A seamless transition of the breakline is only possible, if the bucket is aligned with the said breakline. If the bucket is not aligned, then either the bucket breaks through the reference surface, or a triangular shaped residue is left over.

Prior art excavators can prevent penetrating the reference surface, however at the expense of leaving a residue extruding above the surface. The state of the art requires the repositioning of the excavator, and commencing a second excavating operation, which leads to inefficiencies.

OBJECT OF THE DISCLOSURE

In view of the above circumstances, the object of the present disclosure is to provide a controller for an excavating machine, configured to provide a seamless transition of the breakline, eliminating the need of a second excavating task for removing the residues. The disclosure is further relating to a method and a computer program product to realize the seamless transition of the breakline.

This objective is achieved by realizing the characterizing features described herein.

SUMMARY

The disclosure relates to a controller for an excavating machine. The excavating machine comprises a tool, an arm, a chassis, and a set of sensors.

The excavating machine might be arranged permanently. Alternatively, the excavating machine might be another type of work machine, or a tractor with an excavating arm attached to it temporarily. One or more sensors comprised by set of sensors might be positioned in or on the chassis, the arm, or the tool. One or more sensors comprised by the set of sensors might be positioned externally.

The tool comprises a tool edge. The tool edge might be dedicated for contacting a surface. The tool edge might be a continuous physical edge of the tool, or a fictitious edge, in particular in the case of teethed buckets or rakes. By the way of the example from here on, the position of the tool is represented by the position of the tool edge, in particular the middle of the tool edge. For certain tasks the choice of different reference points might be beneficial. The specific features of alternative reference points, e.g. the center of the tool, might be applied accordingly. By the way of the example from here on the pose of the excavating tool is a pose in an external, in particular global, coordinate system. For certain tasks the choice of different coordinate systems might be beneficial. The specific features of alternative coordinate systems, might be applied accordingly.

The arm comprises multiple links and a tool joint for moving the tool, wherein the tool is attached to the tool joint. While some features of the disclosure are described utilizing a specific design, the present disclosure is not limited to those designs. The present disclosure can be applied for e.g. an excavator or a backhoe type excavating machine. The present disclosure is not limited to a design, wherein the excavating arm is permanently attached. The present disclosure can be realized by excavating machines whose arms are driven by hydraulic means, by means of steel ropes, by means of electric motors or by any alternative means. The present disclosure can be realized by any specific design of the boom, the stick, or the tool joints. The present disclosure can also be realized by another forms of articulated arms.

The set of sensors is configured to provide sensor reading data regarding a position and a heading of the tool. The set of sensors might provide sensor reading data regarding a 6 DoF pose of the tool. The operator might have the freedom to define orientation parameters other than heading. The orientation parameters other than the heading may be limited due to other circumstances relating to the excavation task. The set of sensors might provide sensor reading data regarding a direction of motion of the tool. The set of sensors may further comprise positioning sensors, which provide a sensor reading on the position of the excavator in respect to an external, in particular a global coordinate system. Such sensors might comprise one or more GNSS sensors, in particular high precision GNSS sensors allowing a real time kinematics measurement, or a sensor arrangement gaining information from a geodetic survey device, e.g. a total station. The set of sensors may further comprise imaging, scanning, in particular laser scanning, lidar, or radar sensors. While at least a part of the sensors are required to be located in or on the excavator itself, other sensors, in particular positioning sensors in the form of a total station, might be located in an external position. The present disclosure is no way limited to the utilization of sensors exclusively located in or on the excavator.

The pose of the tool might be provided by direct measurements. The pose of the tool might be provided indirectly by evaluating the state of the chassis and the joints of the arm. The direction of motion of the tool might be provided from a direct measurement. Alternatively the direction of motion might be derived from a rate of change of the pose. Instead of the direction of motion, the velocity vector might also be utilized. Unless otherwise specified the present disclosure might be carried out by partially or completely substituting the direction of motion with the velocity vector. Supplementary to the velocity vector (linear derivative) an angular velocity might also be derived and utilized The controller comprises an input interface, and a computing unit. The controller might comprise an output interface. The input interface, the output interface, and the computing unit are functional and not structural definition of the components of the controller. The computing unit, the input interface, and the output interface might be distributed. Some structural components, in particular touchscreens, might provide functionalities for both the input and output interface. Some structural components might provide functionalities for both the computing unit and the input/output interfaces.

The input interface is configured to receive operator steering commands of an operator regarding a desired position and heading and/or movement of the tool. The input interface might be configured to receive operator steering commands of an operator regarding a desired pose of the tool. The movement of the tool might be a rotation. The operator might operate the excavating machine non-remotely, the present disclosure is however not limited to cases wherein the operator directly operates the excavating machine from the driver cab. The input interface might comprise one or more joysticks. The input interface might allow a direct control of the pose of the links of the arm or the chassis. The input interface might provide the steering commands for the computing unit for a semi-automatic realization of the movement of the excavating tool, in particular in an inverse kinematics. The input interface might comprise the input area of the touchscreen. The input interface might allow the activation of certain features, in particular a selection between manual and semi-automatic modes. The input interface might allow the execution of pre-defined or user-defined automatic movements of the excavator. By the way of example pre-defined or user-defined automatic movements might comprise grading operations with user-defined tool orientation and a pre-defined or a user defined velocity profile (ramp up, constant speed, ramp down). The input interface might allow the activation of operator aid features, in particular to set or limit the velocity of the tool or to lock one or more pose DoF. Such pre-defined or user-defined automatic movements and operator aid features are considered as operator steering commands for the present disclosure. Needless to say that the person skilled in the art, would realize that the above non-exclusive list comprises features which are combinable with each other.

The input interface might be distributed. Certain functions might be controllable by one or more joysticks, by switches/buttons, while other functions might be controllable by one or more touchscreens. Certain functions might be controllable by two or more alternative means, i.e. by a button on the joystick and/or a separate switch and/or via the input area of the touchscreen. The operator might also provide or modify user-defined operator aid features or automatic movements by the input interface. The skilled person could also realize an alternative input interface analogous to the above list. Such combinations and alternatives are within the meaning of the present disclosure.

The computing unit is configured to read the operator steering commands and to control the arm to reproduce the desired position and heading and/or movement of the tool. The operator steering commands might comprise pre- or user defined automatic movements or operator aid features.

The computing unit is configured to read a design model comprising a reference surface. The reference surface comprises two polygons defining a breakline. Polygons according to the present disclosure cover also plane figures which can be locally approximated by polygons near the breakline, in particular non-closed plane figures or plane figures containing curved segments. The computing unit is configured to reference a position and a heading of the tool with respect to the design model. The design model might be a computer aided design model of the excavating task. Needless to say design models based on other design standards are also possible. The direction of motion might be referenced to a first and second polygons of the reference surface. From here on the direction of motion referenced to the second polygon might be called as second direction of motion where this distinction improves the readability of the text. Since the disclosure can be applied without limitations regarding the frame of reference, these terms are purely descriptive to serve the readability. The direction of motion and the second direction of motion are otherwise equivalent features.

In some embodiments the set of sensors comprises imaging, scanning, in particular laser scanning, lidar, or radar sensors. For such embodiments the excavator might obtain continuously or at regular intervals a status on an actual surface. The computing unit might reference the actual surface to the reference surface and might update a status of an excavating task. Some of these sensors might be located in an external position.

The computing unit might store information on the geometry of the excavating tool. The computing unit might store information on the geometry of a plurality of further tools. The actually mounted tool might be recognized via an automatic recognition functionality, or might be selectable by the operator.

The controller is configured for performing a semi-automatic surface following function, in which operator steering command adjustment commands are generated, based on an actual referenced position and heading of the tool with respect to the design model and on actually read operator steering commands, in order to redirect the tool edge in accordance with the reference surface. Needless to say that instead of the position and heading the 6 DoF pose might be utilized.

It goes without saying that the person skilled in the art might implement alternative design solutions to generate operator steering command adjustment commands. The controller might generate additional commands which provide adjustments to the direct operator steering commands to the chassis or the arm. Alternatively the controller might generate a new set of commands based on an interpretation of the operator steering commands and only the new set of commands are transmitted to the chassis and/or the arm. Alternatively, the controller might lock some joints, in particular the joints responsible for the orientation of the tool, and no operator steering commands are transmitted to these joints. The present disclosure is not limited to any specific design choice.

The controller is further configured for performing a semi-automatic breakline-transition function including 1.) identifying a breakline-transition move based on actually read operator steering commands, in particular regarding the direction of motion or the velocity of the tool, and based on actual referenced position and heading of the tool with respect to the breakline of the design model, 2.) generating operator steering command adjustment commands, based on actual referenced position and heading of the tool with respect to the design model and on actually read operator steering commands, in order to bring the tool edge to be aligned in parallel with the breakline.

In some embodiments the semi-automatic breakline transition function can generate operator steering command adjustment commands in order to bring tool edge to be aligned in parallel with the breakline with respect to pre- or user-defined automatic movements. Furthermore, the operator steering command adjustment commands might be generated such that they respect the further operator aid features, in particular the velocity limits.

In some embodiments the semi-automatic breakline-transition function is combined with the semi-automatic surface following function. The semi-automatic breakline-transition function is realized by generating operator steering command adjustment commands based on actual referenced position and heading of the tool with respect to the design model and on actually read operator steering commands, in order to 1.) bring the tool edge to be aligned in parallel with the breakline 2.) redirect the tool edge in accordance with the reference surface. Needless to say that pre- or user defined automatic movements or operator aid features might be utilized in combination with such embodiments.

In some embodiments of the semi-automatic breakline-transition function the direction of motion of the tool is perpendicular to the breakline. The semi-automatic breakline-transition function is realized by generating operator steering command adjustment commands, based on an actual referenced pose of the tool with respect to the design model and on actually read operator steering commands, in order to 1.) bring the tool edge to be aligned in parallel with the breakline, 2.) redirect the tool edge in accordance with the reference surface, 3.) move the tool edge along the direction of motion perpendicular to the breakline.

A non-perpendicular direction of motion towards the breakline might be preferable under certain circumstances. Both perpendicular and non-perpendicular approach directions can be realized with a controller according to the present disclosure. The direction of motion of the tool edge might also be changed during an approach.

In some embodiments after reaching the breakline, the computing unit might align the tool according to the second polygon of the reference surface. Typically a continuous excavating action, wherein the tool movement continues after transiting the breakline and aligned to the second polygon might be preferable. The present disclosure is however not limited to such embodiments. Other embodiments, in particular, wherein the excavating action is stopped at the breakline, might be possible with a controller according to the present disclosure.

In some embodiments the controller is further configured for 1.) storing a prior heading data representing the heading of the tool at the activation of the semi-automatic breakline transition function, 2.) automatically restoring the heading of the tool after transiting the breakline based on the prior heading data. Needless to say that during the restoring movement no part of the tool being below the reference surface. The restoring might be executed such that one end of the tool edge is touching the breakline. The alignment to the breakline might be executed such that one end of the tool edge is touching the breakline. This feature is especially beneficial as heading of the tool could influence whether the residues are deposited on the left or the right side of the tool. Thus the operator might prefer to move the tool such that the tool edge is angled.

In some embodiments the controller is further configured for 1.) storing data representing a prior orientation and direction of motion of the tool representing the state at the activation of the semi-automatic breakline transition function, 2.) generating operator steering command adjustment commands in order to redirect the tool to a second orientation and a second direction of motion after transiting the breakline. The second orientation and second direction of motion relative to the second polygon are respectively equal to the stored prior orientation and direction of motion relative to the first polygon.

In some embodiments, the excavating machine is an excavator. In some more specific embodiments, the excavator has a rotatable chassis.

In some embodiments the excavating machine is a backhoe type excavating machine. Needless to say that the person skilled in the art could imagine further realizations of the excavating machine, other than the specific embodiments listed here.

In some embodiments the excavating tool is a bucket and the tool edge is an attack edge configured to contact the surface. Other tools, in particular rakes, bulldozer blades and loaders, might also be utilized.

In some embodiments the arm comprises a boom and a stick. The boom might be one of several different configurations, e.g. a mono boom allowing no movement apart from straight up and down, or a knuckle boom articulating at the so-called "knuckle" near the middle, letting it fold back like a finger. Another option is a hinge at the base of the boom allowing it to pivot independent to the chassis, e.g. up to 180 degrees. The stick length may depend on the task, in some embodiments the stick length may also be hydraulically adjustable.

In some embodiments the excavating machine is an excavator, the chassis is rotatable to 360°, the tool is a bucket, the arm comprises a boom and a stick ("conventional setup").

In some embodiments the tool joint is a tilt-rotator. Due to the extra DoF provided by the tilt-rotator, excavators equipped with a tilt-rotator are especially suited to realize the present disclosure. Alternative embodiments without tilt-rotators nevertheless might also utilize the present disclosure. The tilt-rotator might be applied together with the "conventional setup" from the preceding paragraph.

In some embodiments the controller is further configured for performing a semi-automatic parallel operation function, including: 1.) identifying a parallel operation move based on actually read operator steering commands, in particular regarding the direction of motion or the velocity of the tool, and based on actual referenced position and heading of the tool with respect to the breakline of the design model, 2.) generating operator steering command adjustment commands, based on actual referenced position and heading of the tool with respect to the design model and based on actually read operator steering commands, in order to a.) redirect the tool edge in accordance with the reference surface, b.) redirect the tool edge into a position, wherein the tool edge touching the breakline, c.) move the tool edge in the reference surface, in a direction parallel to the breakline.

Needless to say that alternative embodiments of the parallel operation function are also possible within the meaning of the present disclosure. In particular a parallel operation wherein the tool edge is steered with an operator selectable offset from the breakline.

Furthermore the breakline-transition and the parallel operation functions might be combinable for reference surfaces comprising more than one breaklines.

In some embodiments the set of sensors is configured to acquire sensor reading data comprising information on an actual surface. In some embodiments the set of sensors comprises at least one of the following: 1.) an imaging sensor, 2.) a scanning sensor, 3.) a lidar, and 4.) a radar. In some embodiments the controller comprises an output interface. The output interface might be configured to display a.) the pose or the position and heading, of the tool, the reference surface, the actual surface, a status of the semi-automatic breakline-transition function and/or the semi-automatic parallel operation function, and b.) a guidance feedback comprises the position and heading of the tool relative to the breakline. Alternatively the guidance feedback might provide visual or acoustic aid to align the heading, the orientation or the pose of the tool to the breakline.

In some embodiments the input interface comprises an input area of a touchscreen. The input area might be configured to activate and deactivate the semi-automatic breakline-transition function and/or the semi-automatic parallel operation function and/or the guidance feedback with their respective options. The touchscreen might be comprised by the output interface and might display whether breakline-transition function and/or the parallel operation function and/or the guidance feedback are active. Alternative display methods by the means of an output area of another screen, by led lights, or by other visual alternatives are also possible.

The output interface might also display the reference surface and the pose, in particular the heading, of the excavating tool. The output interface might display other information, in particular information on the actual surface, the progress of the excavation task, the position of the excavating machine with respect to the local, or the global reference system, the health of the machine components. The output interface might display the current and the desired position of the tool, the output interface might further display the calculated path by the computing unit. Needless to say that the output interface might not display all the information in a given moment. The information displayed on the output interface might be selectable by the operator. The output interface might comprise a touchscreen, wherein the touchscreen might comprise an input area. The operator might select the information to be displayed using the input area. Alternative input devices might also be utilized.

In some specific embodiments the set of sensors comprises at least one positioning sensor. The output interface might further display absolute position of the excavator. Needless to say that set of sensors can comprise both the positioning and scanning sensors.

The present disclosure also relates to a method of semi-automatic breakline-transition. The method comprises the steps of 1.) aligning the tool edge in accordance to the reference surface, 2.) identifying the breakline-transition move based on actually read operator steering commands, in particular regarding the direction of motion or the velocity of the tool, and based on actual referenced position and heading of the tool with respect to the breakline of the design model, 3.) generating operator steering command adjustment commands, based on actual referenced position and heading of the tool with respect to the design model and on actually read operator steering commands, in order to a.) bring the tool edge to be aligned in parallel with the breakline and b.) redirect the tool edge in accordance with the reference surface.

In some embodiments tool edge is steered in a direction of motion perpendicular to the breakline. The operator steering command adjustment commands, based on actual referenced position and heading of the tool with respect to the design model and on actually read operator steering commands, are generated in order to a) bring the tool edge to be aligned in parallel with the breakline, b.) redirect the tool edge in accordance with the reference surface, and c.) move the tool edge in a direction of motion perpendicular to the breakline.

In some embodiments the tool edge is stopped automatically at the breakline. After stopping the tool edge, the operator may start a new excavating action at a different location. The operator may continue the transition to the second polygon after aligning the tool. The input interface might be configured to activate a function of stopping at the breakline. The output interface might display whether the function of stopping at the breakline is active.

In some embodiments the direction of motion of the tool is automatically aligned to the second polygon at the breakline. After the alignment the tool might continue with the excavating action in the second polygon. These embodiments are especially beneficial, since they enable a seamless transition of the breakline, without an excessive effort from the operator.

In some embodiments the movement of the tool is unsuspended during the alignment of the tool. These embodiment are especially beneficial, since in these embodiments the alignment process does not disturb the excavating task. Furthermore they also allow to keep the tool aligned, while the direction of motion of the tool being changed. This is especially beneficial for more complex excavation tasks. The controller and/or the operator might limit the extent of the alignment to be carried out during the movement of the tool to protect the tool. Other embodiments, where only certain types of alignments are allowed during the movement of the tool are also within the meaning of the disclosure.

Alternatively the tool edge might also be aligned in another way, wherein the movement of the tool is first paused, the alignment of the tool carried out, and the movement is restarted after finishing the alignment. The tool might be aligned when the tool edge is touching the breakline, this embodiment is especially beneficial if a heading bias being preferred to push the residues to a given side of the tool. In this alignment method the tool is not steered without a heading bias.

The present disclosure also relates to a method of semi-automatic parallel operation. The method comprises the steps of: 1.) identifying a parallel operation move based on actually read operator steering commands, in particular regarding the direction of motion or the velocity of the tool, and based on actual referenced position and heading of the tool with respect to the breakline of the design model, 2.) generating operator steering command adjustment commands, based on actual referenced position and heading of the tool with respect to the design model and based on actually read operator steering commands, in order to a.) redirect the tool edge in accordance with the reference surface b.) redirect the tool edge into a position touching the breakline, and c.) move the tool edge in the reference surface, in a direction parallel to the breakline.

Alternative embodiments of the parallel operation are also possible. E.g. it is possible to align the tool that its direction of motion and orientation is parallel to the breakline, while its position is in a predefined distance. Such alignments might be useful for an excavating task to be carried out parallel to the breakline at a certain distance, e.g. excavating a ditch parallel to a motorway embankment or cleaning the breakline from residues.

Furthermore the semi-automatic breakline-transition method and the semi-automatic parallel operation method might be combinable for reference surfaces comprising more than one breaklines The present disclosure also relates to a computer program product for a specific embodiment of the controller, which, when executed by the computing unit, causes the automatic execution of the steps of a selected embodiment of the semi-automatic breakline-transition method.

The present disclosure also relates to a computer program product for a specific embodiment of the controller, which, when executed by the computing unit, causes the automatic execution of the steps of a selected embodiment of the semi-automatic parallel operation method.

BRIEF DESCRIPTION OF THE DRAWINGS

By way of example only, specific embodiments will be described more fully hereinafter with reference to the accompanying figures, wherein.

DETAILED DESCRIPTION

Figure 1A:
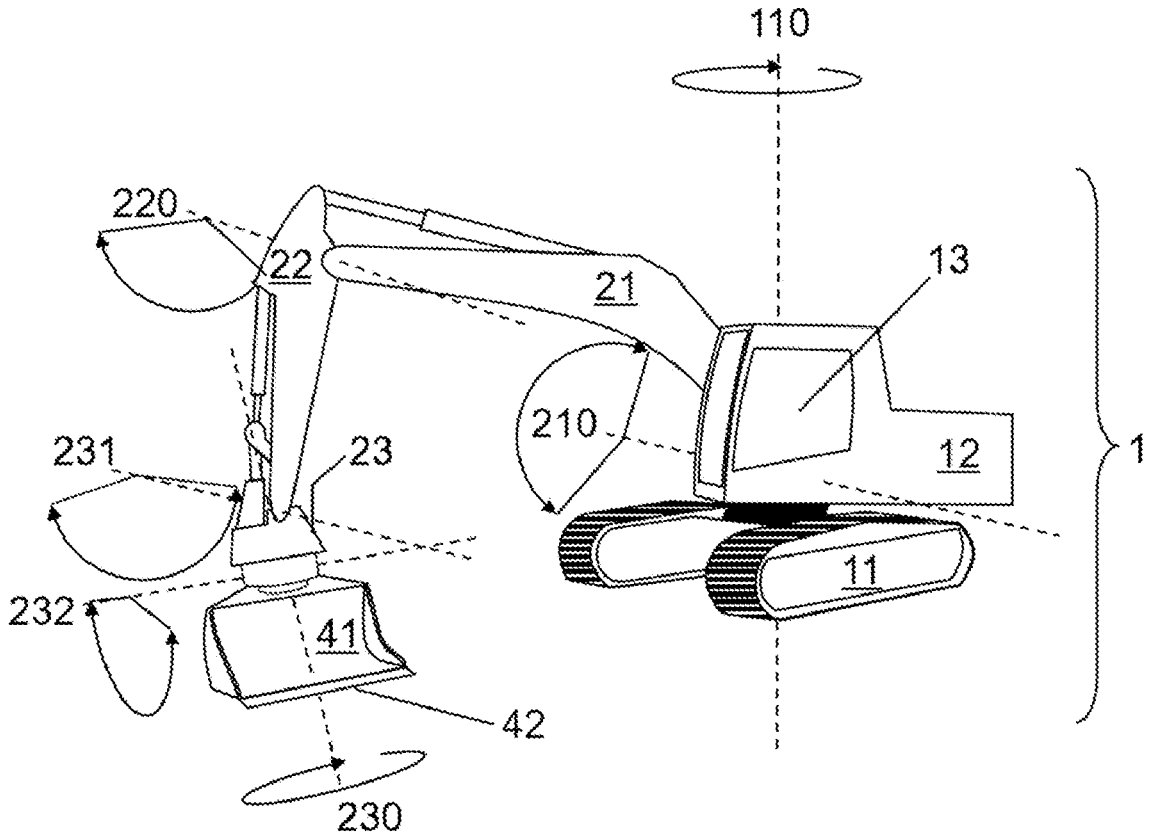
FIG. 1*a* shows the schematics of an excavator.

FIG. 1*a* depicts a schematics of an embodiment of the excavating machine as an excavator 1. The depicted embodiment comprises a tracked undercarriage 11, a chassis 12, which is rotatable to the undercarriage with about ±180° around a rotation axis 110, an excavator arm, and a bucket as a tool 41.

It is immediately clear for the person skilled in the art that a wheeled undercarriage 11 lies also in the meaning of the present disclosure. Furthermore embodiments, where the chassis 12 is fixed or only a swing movement of the chassis 12 with yaw angle considerably less ±180° is allowed in respect to the undercarriage 11 are also within the meaning of the present disclosure.

The excavating arm comprises a boom 21, in the depicted embodiment a monoboom. The boom 21 is attached to the chassis 12 next to driver cabin 13. Alternative embodiments of the boom 21, in particular knuckle booms, are also within the meaning of the present disclosure. The boom can be at least pitched around a pitching axis 210 in respect to the chassis 12. Alternative embodiments, e.g. where the boom 21 can swing in horizontally in respect to the chassis 12 are also within the meaning of the present disclosure.

The excavating arm further comprises a stick 22. The stick 22 can swivel around a swivel axis 220. In the depicted embodiment, the excavator 1 utilizes hydraulic cylinders to pitch the boom 21 and the stick 22. Contemporary excavators 1 typically utilize various hydraulic components, however alternative means of driving the components of the excavating arm are also within the meaning of the present disclosure. The excavating arm might be another form of articulated arm. The present disclosure is not limited to the "conventional setup".

The tool 41 is attached to the tool joint at the end of the stick 22. The tool joint in the depicted embodiment is a tilt-rotator 23. A tilt-rotator 23 can best be described as a wrist between the stick 22 and the tool 41, allowing the tool 41 to rotate—typically by 360 degrees—about a rotor axis 230, wherein the tool 41 can further be swiveled, e.g. in each case up to ±45 degrees, about a pitch axis 231 perpendicular to the rotor axis 230, and a tilt axis 232 perpendicular to the rotor axis 230 and the pitch axis 231. While the tilt-rotator 23 is especially suitable to realize the technical features of the present disclosure, they are not a mandatory component of an excavating machine according to the present disclosure.

The tool 41 comprises a tool edge 42. The tool edge might be configured for contacting a surface. In the depicted bucket, the tool edge 42 is the continuous, real edge of the tool 41. For other types of tool 41, in particular teethed buckets or rakes, the tool edge 42 is a fictitious, but definable segment of the tool 41.

Figure 1B:
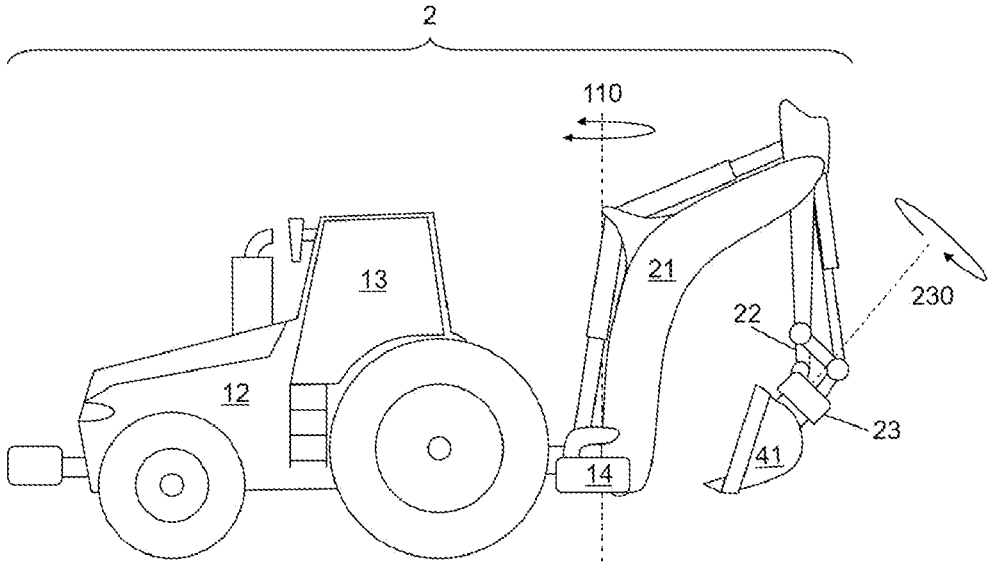
FIG. 1*b* shows the schematics excavating machine embodied as a tractor equipped with a backhoe excavating arm.

FIG. 1*b* shows an embodiment of the excavating machine as a backhoe 2 type of excavating machine. The chassis 12 in the depicted embodiment is a tractor. Other type of work machines, in particular bulldozers or loaders, can also serve as the chassis 12, any of these and further alternative embodiments can be utilized to realize the present disclosure.

The excavating arm, comprising the boom 21 and the stick 22, is attached to a joint 14, and can be swiveled around the rotation axis 110. The boom 21 and the stick 22 can be pitched similarly to that of an excavator 1. The tool joint might be a tilt-rotator 23 or similar or alternative joints with equivalent characteristics. For transparency reasons only the rotor axis 230 is shown in FIG. 1.*b*. Apart from the mounting of the arm, the backhoe 2 type represents the same options as the excavator 1 type. Consequently, the person skilled in the art could carry out the present disclosure irrespective of the design of the excavating machine. The tool 41 in the here depicted embodiment is a teethed bucket. Other tools 41, in particular other types of buckets, blades, loaders or rakes, might be utilized by an excavating machine according to the present disclosure.

In some embodiments the excavator arm might be permanently arranged on the chassis, in other embodiments, in particular backhoe 2 type arrangements, it might be an auxiliary equipment temporarily arranged. The present disclosure is not limited to excavating machines with permanently arranged excavator arms.

Figure 2:
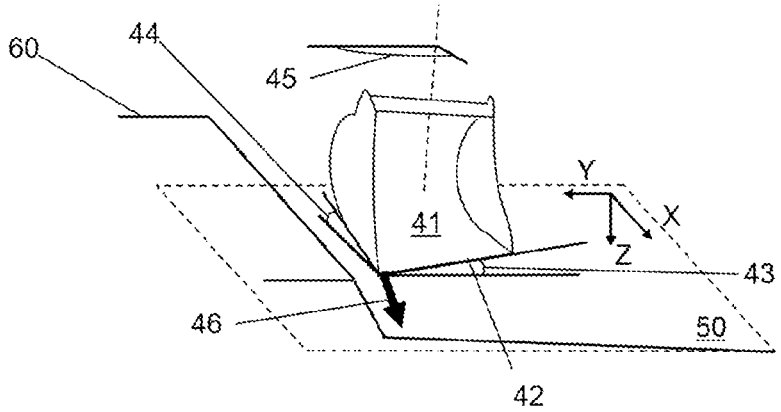
FIG. 2 shows the schematics of a coordinate system for the tool in respect to the reference surface.

FIG. 2 shows the bucket 41 upon establishing contact with the reference surface 50. The depicted area of the reference surface 50, marked as a dashed line, is far away from the breakline and is a flat surface without any further feature. The actual surface marked as the continuous line, can have a shape different than the reference surface 50. In some embodiments the actual surface 60 might be acquired by the set of sensors. In some other embodiments, the bucket 41 is only referenced to the reference surface 50.

In the depicted embodiment the position of the tool 41, in particular the x,y,z position of the center of the edge 42, is referenced to the reference surface 50, in particular to the polygon the nearest to the edge 42. The direction of motion 46 the tool 41 might also be referenced to the reference surface 50. For an excavator 1 according to the present disclosure, the direction of motion 46 and the orientation of the tool 41 might be independent from each other. This means that the direction of motion 46 of the tool 41 is determined by the orientation of the chassis 12, boom 21 and stick 22, while the orientation of the tool 41 can be independently adjusted by the DoF provided by e.g. a tilt-rotator 23.

FIG. 2 shows a possible coordinate system relative to the reference surface 50. The orientation of the bucket can be defined utilizing three angles. The angle relative to a plane perpendicular to the Z-axis 44 is traditionally referred as the attack angle, the angle relative to the a plane perpendicular to the X-axis 43 is traditionally referred as the crosscut angle, while the third angle relative to a plane perpendicular to the Y-axis 45 is the heading angle. Alternative definitions of the orientation are within the meaning of the disclosure. Needless to say that the present disclosure is not bound to any specific reference systems, and the person skilled in the art can realize the disclosure using any convenient coordinate system.

The tool edge 42 might be aligned with the reference surface 50 by the following workflow. The x,y,z position of the tool is chosen so, that the tool 41 is substantially above the reference surface 50, i.e. no changes of the tool orientation might lead to a situation, that a part of the tool 41, in particular the tool edge 42 is below the reference surface 50. The tool 41 is aligned so that the crosscut angle 43 to be 0°. The attack angle 44 is aligned so that upon lowering the tool to contact the reference surface 50 no part of the tool 41 will be below the reference surface 50. The tool 41 is lowered to establish contact with the reference surface 50. During the lowering of the tool 41, the attack angle 44 might change. It is clear for the skilled person, that alternatives for this exemplary workflow exist, in particular an alternative workflow might be realized when the tool 41 is near to the reference surface 50, in particular when the tool edge 42 already contacted the reference surface 50. The skilled person could realize a workflow optimized for the specific embodiment of the excavating machine.

A typical excavator has more DoF than are strictly necessary for the task of grading a planar reference surface 50. This means that the bucket edge 42 can be aligned with the surface using multiple combinations of attack angles 44 and heading angles 45. The attack angle 44 might be optimized depending the excavating task, wherein the heading angle 45 might be optimized so that direction of motion 46 of the tool lays in a plane perpendicular to the tool edge 42. Alternatively the heading angle 45 might be optimized to drive the residues to a given side of the tool 41. For an excavating operation from the left to the right, it is beneficial that the left side stays clean and the residues are driven to the right side.

Figure 3A:
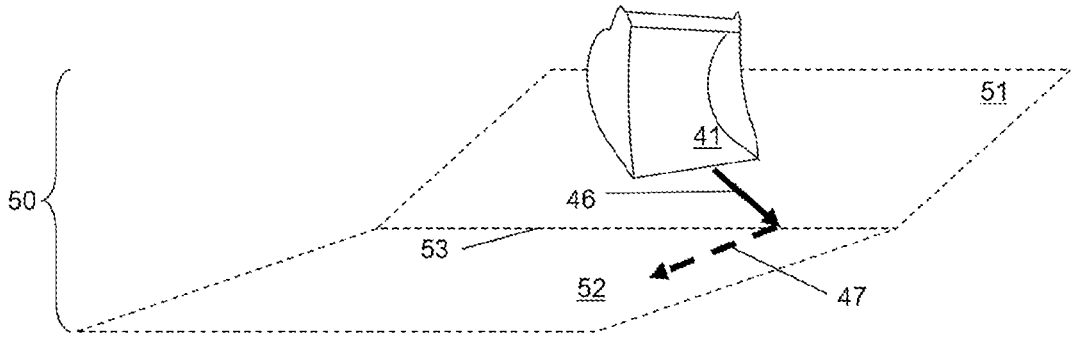
FIG. 3*a* shows an example of a breakline defined by two interconnected polygons in the reference surface.

FIG. 3*a* shows an example wherein the reference surface 50 comprises two polygons 51,52. An intersection of the two polygons 51,52 is colloquially known as a breakline 53. The polygon closest to the bucket 41 is defined as the first polygon 51. The direction of motion 46 of the bucket 41 is such that it approaches the breakline 53. The polygon on the other side of breakline is a second polygon 52. A second direction of motion 47 of the tool 41 in the second polygon 52 might be different from the actual direction of motion 46. The direction of motion 46,47 might change at any point during the transition operation. In some embodiments the reference frame might change after transiting the breakline 53. The excavating action might stop at the breakline 53.

Figure 3B:
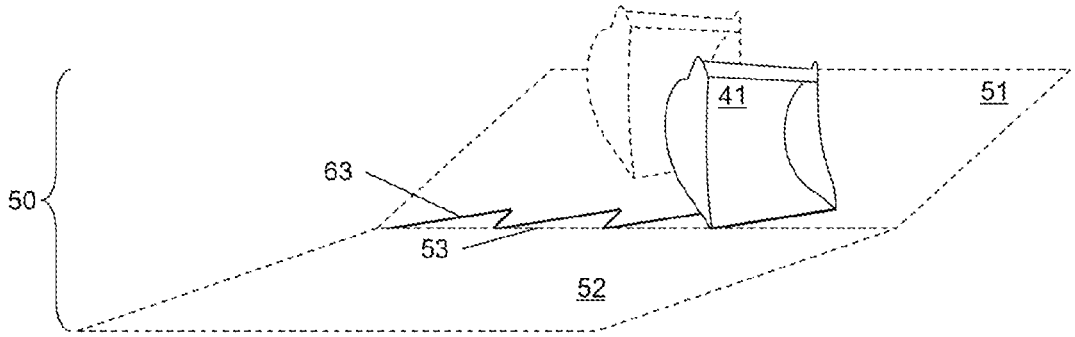
FIG. 3*b* shows the prior art of excavating near the breakline.

FIG. 3*b* shows the prior art of excavating near the breakline 53. While the bucket 41 is aligned to the first polygon 51 it is not aligned to the breakline 53. The prior art automatic systems are capable of preventing the tool to break through the reference surface 50 at the second polygon 52, nevertheless the cost of this is the presence of triangular shape residues remaining in the actual breakline 63. To remove the residues a second excavating step is needed, which might even require the repositioning of the excavator 1.

Figure 3C:
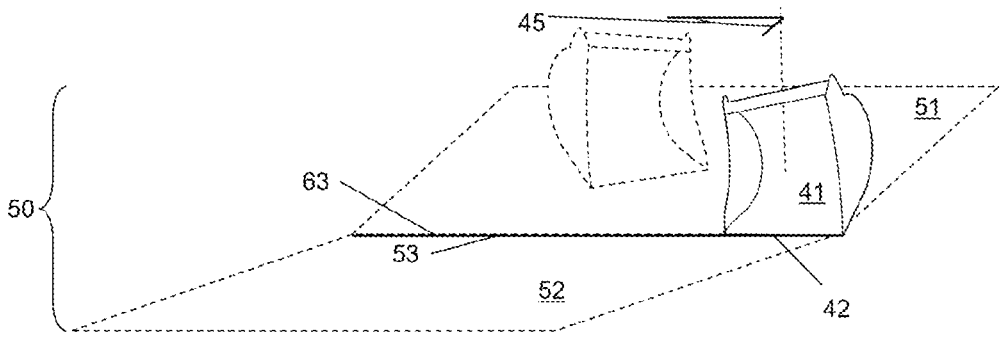
FIG. 3*c* shows the excavating near the breakline.

FIG. 3*c* shows the excavating near the breakline 53 according to the present disclosure. The heading angle 45 of the bucket is aligned so, that upon reaching the breakline 53 the tool edge 42 is parallel to the breakline. As a result the actual breakline 63 corresponds to the breakline 53 of the reference surface 50 and no second excavating step is required to clean the residues.

The semi-automatic breakline-transition function includes the identification of a breakline-transition move based on actually read operator steering commands and on actual referenced position and heading 45 of the tool 41 with respect to the breakline 53. The further angular components of the actual referenced pose might also be utilized in the identification of the breakline-transition move. The identification of the breakline transition might be based on the direction of motion 46 or the velocity vector of the tool 41.

In some embodiments the identification is based on a first criterion. The first criterion comprises the tool edge 42 is essentially parallel to the breakline 53 and the tool 41 is approaching the breakline 53 along a direction of motion 46 essentially perpendicular to the breakline 53. Essentially parallel and essentially perpendicular for the present disclosure means that the operator positioned the tool 41 with the intention of transiting the breakline 53.

The semi-automatic breakline-transition function further includes generating operator steering command adjustment commands, based on actual referenced pose of the tool with respect to the design model and on actually read operator steering commands, in order to bring the tool edge 42 to be aligned in parallel with the breakline 53.

In the embodiment depicted on FIG. 3*c* the operator steering command adjustment commands further comprise the surface following function. While this embodiment of the excavating task is beneficial that it result in an actual surface 60 corresponding the desired reference surface 50 other embodiments are also within the meaning of the present disclosure.

The excavating task might end at the breakline 53, the excavating task can also continue into the second polygon 52. The bucket 41 might be aligned to the second polygon 52 at the breakline 53. The seamless transition of the breakline 53 and excavating on both polygons 51,52 is an especially beneficial way of using the present disclosure. The present disclosure, however, places no limitation on the excavating tasks to be performed.

The alignment of the bucket 41 might be carried out during the approach phase in a continuous fashion. The alignment might be carried out in a two-step process, where the movement of the bucket 41 is first put on hold, and the movement continues after the alignment is complete. A semi-automatic alignment process, without a pause or an extra operator action, is an especially beneficial way of using the present disclosure. Embodiments, wherein the alignment is carried out upon a request from the operator are also within the meaning of the present disclosure. In some embodiments guidance feedback might be generated to aid the operator to manually align the tool 41 to the breakline 53, if due to specific circumstances, the operator prefers to carry out a manual alignment.

Figure 4A:
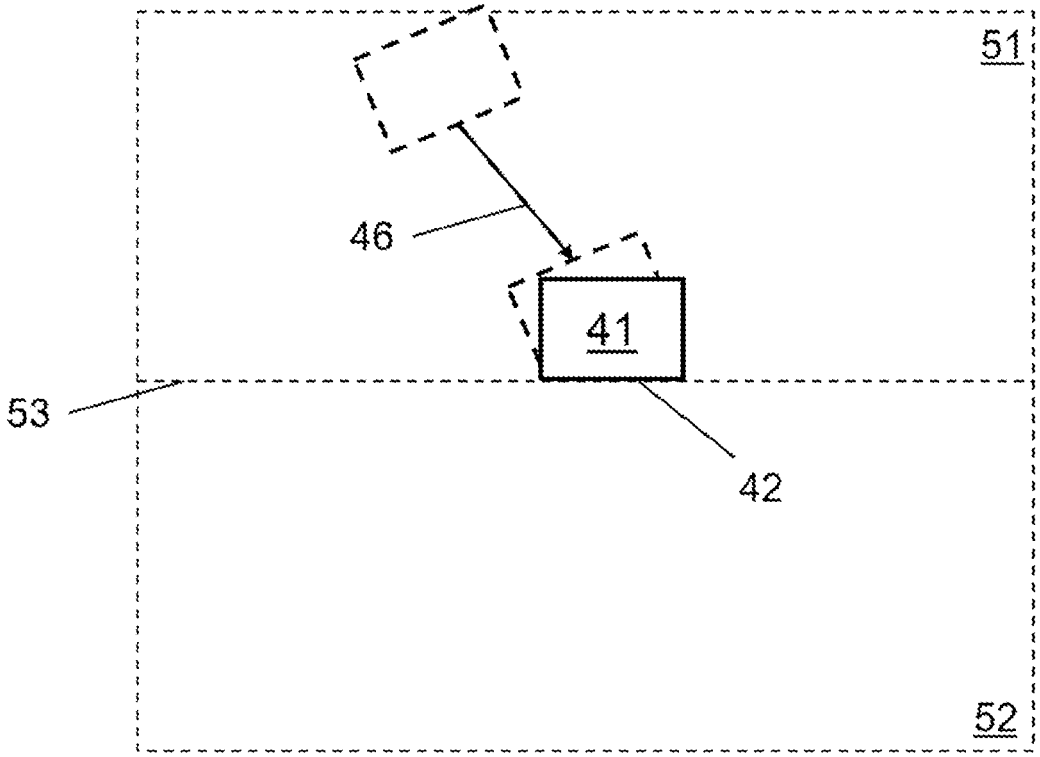
FIG. 4*a* shows the schematics of the movement of the tool in the first polygon during a breakline transition with pose restoring.
Figure 4B:
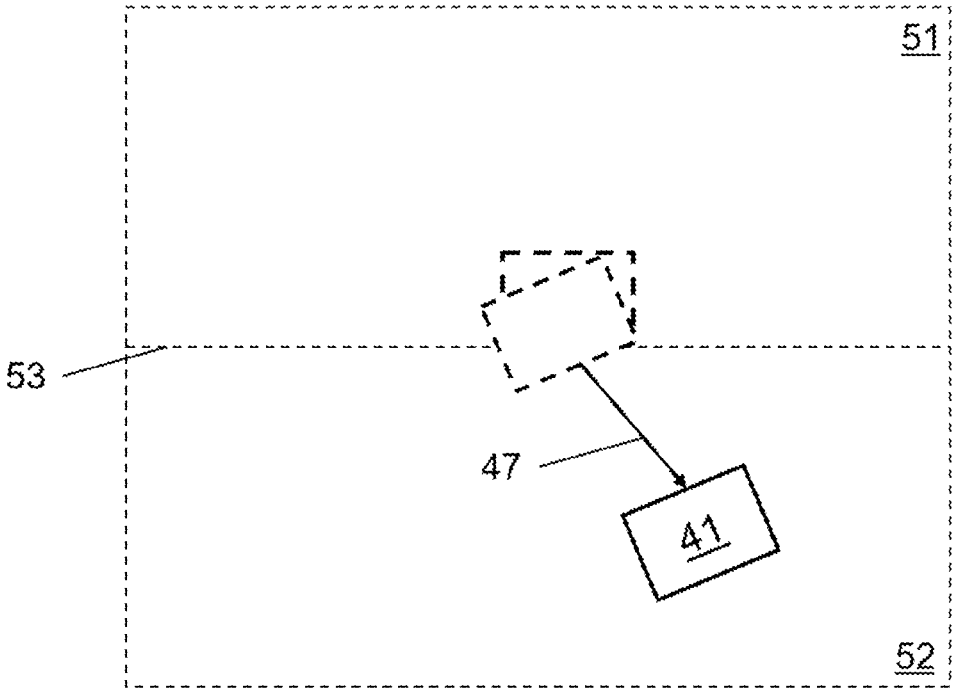
FIG. 4*b* shows the schematics of the movement of the tool in the second polygon during a breakline transition with pose restoring.

FIGS. 4*a* and 4*b* shows the schematics in a top view of a breakline transition wherein the orientation of the tool 41 is restored after the transition of the breakline. In the first polygon 51 the tool is moved along a direction of motion 46, the orientation of the tool 41 might be characterized by the crosscut 43, attack 44 and heading angles 45. The tool 41 might be redirected in accordance with the first polygon 51, i.e. the crosscut angle 43 might be 0° and the direction of motion 46 might be parallel to the first polygon 51.

Upon reaching the breakline 53 the heading 45 of the tool 41 is changed such that the tool edge 42 aligned in parallel with the breakline 53. In the depicted embodiment the alignment executed such that one end of the tool edge 42 is touching the breakline 53. The tool 41 might be redirected at the breakline 53 in accordance to the second polygon 52.

After transiting the breakline operator steering command adjustment might be generated in order to align the tool to the second orientation and the second direction of motion 47 in respect to the second polygon 52. The second orientation and second direction of motion 47 relative to the second polygon 52 are respectively equal to the prior orientation and direction of motion 46 relative to the first polygon 51 In the depicted embodiment the restoring is executed such that one end of the tool edge 42 is touching the breakline 53. Instead of the directions of motion 46,47 the velocities might be utilized, if having an identical speed of the tool 41 is beneficial.

Figure 5:
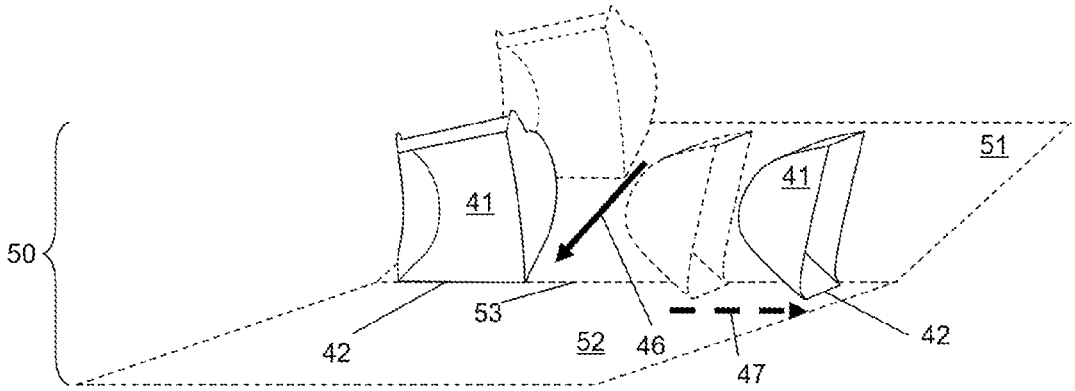
FIG. 5 shows the schematics of two modes of excavating near the breakline, with a transition and parallel to the breakline.

FIG. 5 depicts two modes of excavating task near the breakline. In the first type of operation the direction of motion 46 of the bucket 41 intersects the breakline 53 of the first polygon 51 and the second polygon 52. The intent of the operator is at least to reach the breakline 53 or to transit to the second polygon 52. In the second type of operation the bucket 41 has the second direction of motion 47 essentially parallel to the breakline 53, i.e. the intent of the operator in this case is not to transit the breakline 53.

In some embodiments the controller being further configured to perform a semi-automatic parallel operation function. The semi-automatic parallel operation function comprises identifying a parallel operation based on actually read operator steering commands and based on actual referenced position and heading 45 of the tool 41 with respect to the breakline 53 of the design model.

In some embodiments the identification is based on a second criterion. The second criterion comprises that the second direction of motion 47 of the tool 41 is essentially parallel to the breakline 53, and the tool edge 42 is essentially touching the breakline 53. Essentially parallel and essentially touching for the present disclosure means that the operator positioned the tool 41 with the intention of excavating parallel to the breakline 53. The direction of motion 46 and second direction of motion 47 are purely descriptive and introduced for readability reasons alone. The two directions of motion 46,47 represent equivalent features.

Needless to say that alternative formulations for the first and second criteria are possible for the present disclosure. In particular the first and second criteria might also comprise the speed of the tool. Alternatively the first and second criteria might be provided on the basis of the previous excavating actions.

Although aspects are illustrated above, partly with reference to some specific embodiments, it must be understood that numerous modifications and combinations of different features of the embodiments can be made. All of these modifications lie within the scope of the appended claims.

The invention claimed is:

1. A controller for an excavating machine, the excavating machine comprising a tool comprising a tool edge, an arm comprising multiple links and a tool joint for moving the tool, wherein the tool being attached to the tool joint, a set of sensors configured to provide sensor reading data regarding a position and a heading of the tool, and a chassis, the controller comprising an input interface and a computing unit, the input interface being configured to receive operator steering commands of an operator regarding a desired position and heading and/or movement of the tool, the computing unit being configured to read the operator steering commands and to control the arm to reproduce the desired position and heading and/or movement of the tool, the computing unit being configured to read a design model comprising a reference surface, wherein the reference surface comprising two polygons defining a breakline, the computing unit being configured to reference the position and heading of the tool with respect to the design model, the controller being configured for performing a semi-automatic surface following function, in which operator steering command adjustment commands are generated, based on an actual referenced position and heading of the tool with respect to the design model and on actually read operator steering commands, in order to redirect the tool edge in accordance with the reference surface, the controller being further configured for performing a semi-automatic breakline-transition function including identifying a breakline-transition move based on actually read operator steering commands and based on actual referenced position and heading of the tool with respect to the breakline of the design model, generating operator steering command adjustment commands, based on actual referenced position and heading of the tool with respect to the breakline and on actually read operator steering commands, in order to bring the tool edge to be aligned in parallel with the breakline.

2. The controller according to claim 1, wherein the controller being configured for performing the semi-automatic breakline-transition, generating operator steering command adjustment commands, based on actual referenced position and heading of the tool with respect to the design model and on actually read operator steering commands, in order to bring the tool edge to be aligned in parallel with the breakline, and redirect the tool edge in accordance with the reference surface.

3. The controller according to claim 2, wherein the controller being configured for performing the semi-automatic breakline-transition, generating operator steering command adjustment commands, based on an actual referenced position and orientation of the tool with respect to the design model and on actually read operator steering commands, in order to move the tool edge along a direction of motion perpendicular to the breakline.

4. The controller according to claim 1, wherein the controller being further configured for storing a prior heading data representing the heading of the tool at the activation of the semi-automatic breakline transition function, automatically restoring the heading of the tool after transiting the breakline based on the prior heading data.

5. The controller according to claim 1 wherein the excavating machine being an excavator,
the chassis being rotatable to 360°,
the tool being a bucket,
the arm comprising a boom and a stick,
the tool joint being a tilt-rotator.

6. The controller according to claim 1, wherein the controller being further configured for performing a semi-automatic parallel operation function, including
identifying a parallel operation move based on actually read operator steering commands and based on actual referenced position and heading of the tool with respect to the breakline of the design model,
generating operator steering command adjustment commands, based on actual referenced position and heading of the tool with respect to the design model and based on actually read operator steering commands, in order to
redirect the tool edge in accordance with the reference surface,
redirect the tool edge into a position, wherein the tool edge touching the breakline, and
move the tool edge in the reference surface, along the direction of motion parallel to the breakline.

7. The controller according to claim 6, wherein,
the set of sensors being configured to acquire sensor reading data comprising information on an actual surface,
the controller comprising an output interface, the output interface being configured to display
the position and heading of the tool, the reference surface, the actual surface, and a status of the semi-automatic breakline-transition function and/or the semi-automatic parallel operation function, and
a guidance feedback comprising the position and heading of the tool relative to the breakline.

8. The controller according to claim 7, wherein the input interface comprising an input area of a touchscreen, the input area being configured to activate and deactivate the semi-automatic breakline-transition function and its options and/or the semi-automatic parallel operation function and its options and/or the guidance feedback and its options.

9. A method of semi-automatic parallel operation function for an excavating machine equipped with the controller of claim 8, the method comprising the steps of:
identifying a parallel operation move based on actually read operator steering commands and based on actual referenced position and heading of the tool with respect to the breakline of the design model
generating operator steering command adjustment commands, based on actual referenced position and heading of the tool with respect to the design model and based on actually read operator steering commands, in order to:
redirect the tool edge in accordance with the reference surface,
redirect the tool edge into a position touching the breakline, and
move the tool edge in the reference surface, along the direction of motion parallel to the breakline.

10. A method of semi-automatic parallel operation function for an excavating machine equipped with the controller of claim 6, the method comprising the steps of:
identifying a parallel operation move based on actually read operator steering commands and based on actual referenced position and heading of the tool with respect to the breakline of the design model
generating operator steering command adjustment commands, based on actual referenced position and heading of the tool with respect to the design model and based on actually read operator steering commands, in order to:
redirect the tool edge in accordance with the reference surface,
redirect the tool edge into a position touching the breakline, and
move the tool edge in the reference surface, along the direction of motion parallel to the breakline.

11. A computer program product for a controller, which, when executed by a computing unit, causes the automatic execution of the steps of the method according to claim 10.

12. A method of semi-automatic breakline-transition for an excavating machine equipped with a controller of claim 1, the method comprising the steps of,
aligning the tool edge in accordance to the reference surface, characterized in that
identifying the breakline-transition move based on actually read operator steering commands and based on actual referenced position and heading of the tool with respect to the breakline of the design model,
generating operator steering command adjustment commands, based on actual referenced position and heading of the tool with respect to the design model and on actually read operator steering commands, in order to bring the tool edge to be aligned in parallel with the breakline, and
redirect the tool edge in accordance with the reference surface.

13. The method according to claim 12, wherein the tool edge being stopped automatically at the breakline.

14. The method according to claim 12, wherein the direction of motion of the tool being automatically aligned to a second polygon at the breakline.

15. The method according to claim 12, wherein the movement of the tool being unsuspended during the alignment of the tool.

16. A computer program product for a controller, which, when executed by a computing unit, causes the automatic execution of the steps of the method according to claim 15.

17. A computer program product for a controller, which, when executed by a computing unit, causes the automatic execution of the steps of the method according to claim 12.

* * * * *